United States Patent [19]

Koide

[11] Patent Number: 4,522,140

[45] Date of Patent: Jun. 11, 1985

[54] CLUTCH FOR SEWING MACHINE THREAD WINDING MECHANISM

[75] Inventor: Akio Koide, Kokubunji, Japan

[73] Assignee: Janome Sewing Machine Industry Co., Ltd., Japan

[21] Appl. No.: 577,410

[22] Filed: Feb. 6, 1984

[30] Foreign Application Priority Data

Feb. 4, 1983 [JP] Japan ..... 58-14462[U]

[51] Int. Cl.[3] ..... D05B 59/00

[52] U.S. Cl. ..... 112/279; 192/67 P

[58] Field of Search ..... 112/279, 271, 220; 192/67 P

[56] References Cited

U.S. PATENT DOCUMENTS 4,091,755 5/1978 Ishikawa et al. ..... 112/279

4,105,106 8/1978 Geis ..... 192/67 P X

FOREIGN PATENT DOCUMENTS 119624 4/1945 Sweden ..... 112/279

*Primary Examiner*—Werner H. Schroeder

*Assistant Examiner*—Andrew M. Falik

*Attorney, Agent, or Firm*—William A. Drucker

[57] ABSTRACT

In a sewing machine, a stop-motion mechanism is provided for selectively performing stitching operation and thread winding operation. The stop-motion mechanism has a pulley secured to one end of a main drive shaft, which is driven by an electric motor, and a transmission disc for transmitting rotation of the pulley to a loop taker. To the pulley is detachably connected an operating member having a pair of engaging pins adapted to extend through the pulley. The operating member is rotated together with the pulley but axially displaceable with respect to the pulley between two positions, one position being close to the pulley in which engagement between the engaging pins and the transmission disc is established so that rotation of the pulley is transmitted to the transmission disc for ordinary stitching operation, and the other position being away from the pulley in which the engaging pins are disengaged from the transmission disc so that the transmission disc is stationary while the pulley is rotated for thread winding operation.

4 Claims, 7 Drawing Figures

CLUTCH FOR SEWING MACHINE THREAD WINDING MECHANISM

BACKGROUND OF THE INVENTION

This invention relates to a sewing machine in general, and more particularly to a stop-motion mechanism of a driving pulley for selectively performing stitching operation and thread winding operation.

There has been proposed a stop-motion mechanism of a driving pulley of a sewing machine, for example, in Japanese Utility Model Application No. 100751/1974 (laid open), in which a flywheel is normally connected by a fastening screw to a bushing secured to an upper shaft and is rotated together with the upper shaft, but may be disconnected from the latter by loosening the screw, so that the flywheel may be rotated with respect to the upper shaft. This mechanism is simple in structure but a considerable force is required to manipulate the operating screw.

Additionally, a few attempts have been made to provide a stop-motion mechanism, for example, in Japanese Patent Specifications (published) Nos. 13138/1965 and 5301/1968, wherein an operating member is moved along the upper shaft, thereby separating a flywheel from the upper shaft. Such mechanism is advantageous in that only a small operating force is required, but because of too many components it is difficult and troublesome to assemble and disassemble the same.

SUMMARY OF THE INVENTION

It is therefore an object of the invention to provide a stop-motion mechanism of a sewing machine which can be operated with a small force and a simple operation.

Another object of the invention is to simplify the mechanism and make it easy to assemble the same.

Still another object of the invention is to provide a stop-motion mechanism which is substantially free from mechanical troubles.

Still another object of the invention is to provide a stop-motion mechanism, essential parts of which are constructed as a unit, thereby facilitating repair and removal thereof.

According to the invention there is provided a stop-motion mechanism used in a sewing machine having a main drive shaft rotated to vertically reciprocate a needle to penetrate a fabric for forming stitches thereon. This comprises a rotation transmission member secured near one end part of the main drive shaft and having a plurality of grooves formed thereon; a pulley rotated by driving means and having a knurled face for thread winding operation and a central hollow axis, the pulley being secured to the end part of the main drive shaft and being prevented from axial movement but rotatable relative to the main drive shaft; an operating member rotatable together with the pulley, but axially displaceable with respect to the pulley between two positions, one position being close to the pulley and the other being away from the pulley; and means for selectively transmitting rotation of the pulley to the rotation transmission member. When the operating member is in the position close to the pulley the transmitting means is engaged with any of the grooves of the rotation transmission member so that rotation of the pulley is transmitted to the rotation transmission member for stitching operations When the operating member is in position away from the pulley the means is disengaged from the grooves of the rotation transmission member so that the pulley alone is rotated for thread winding operation.

The operating member and the selective transmission means are formed as an assembly unit which is removably connected to the pulley.

BRIEF DESCRIPTION OF DRAWINGS

Further objects and advantages of the invention can be fully understood from the following detailed description when read in conjunction with the accompanying drawings in which.

PREFERRED EMBODIMENT OF THE INVENTION

Figures 1, 2:
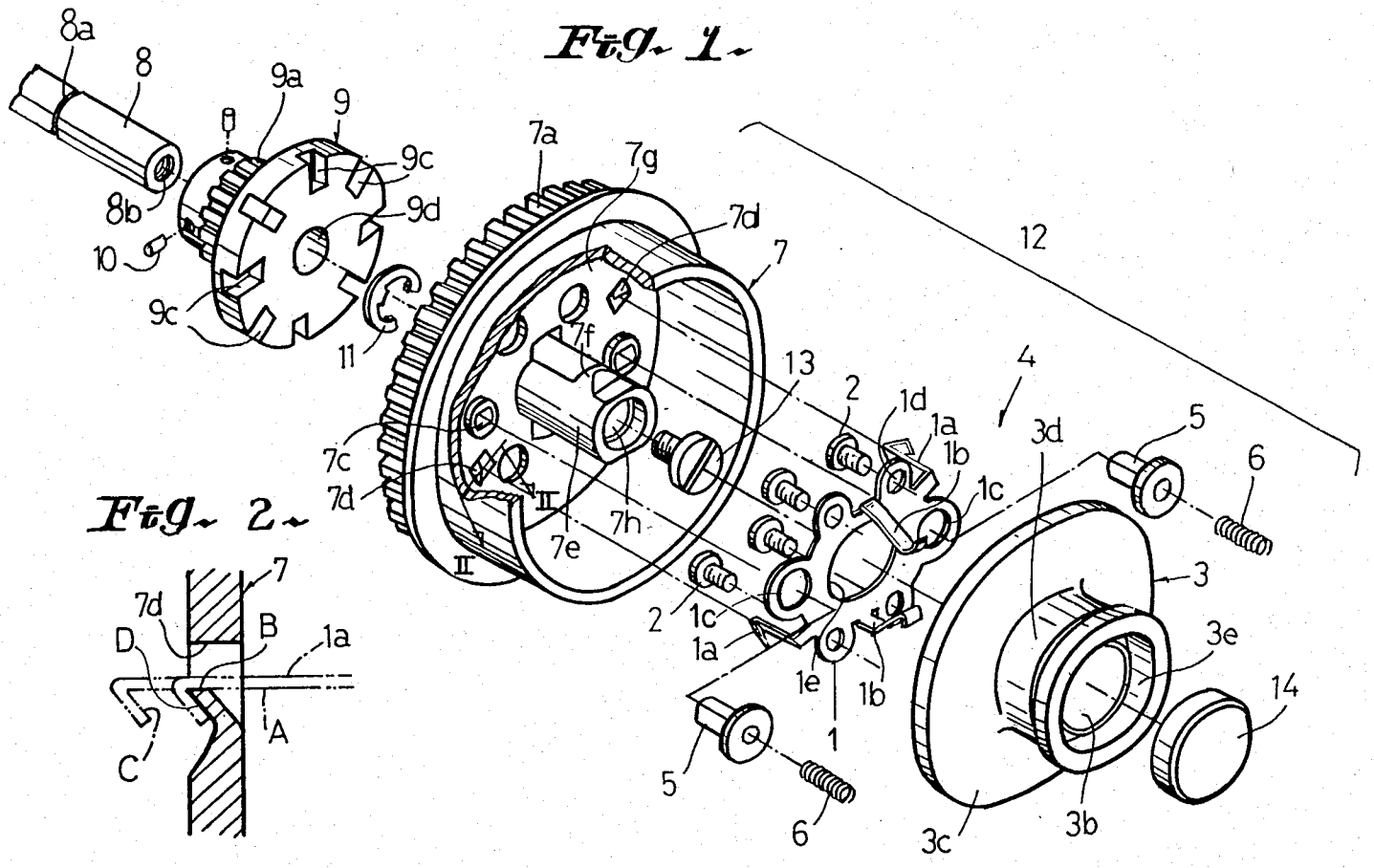
FIG. 1 is an exploded perspective view of a stop-motion mechanism according to the invention.
FIG. 2 is a sectional view taken in the direction of the arrows along the line II—II of FIG. 1.

Referring specifically to FIG. 1, in a stop-motion mechanism according to the invention there is provided an operating plate 1 of an elastic material having a central opening 1*e* formed therein. Around the central opening 1*e* are formed a pair of engaging legs 1*a* and a pair of positioning legs 1*b*, projecting in the opposite axial directions, and a pair of openings 1*c* and another plurality of holes 1*d*.

Figure 4:
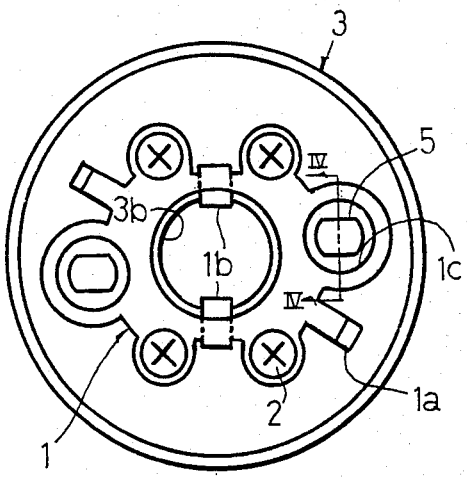
FIG. 4 is a view taken in the direction of the arrow F of FIG. 3.
Figure 3:
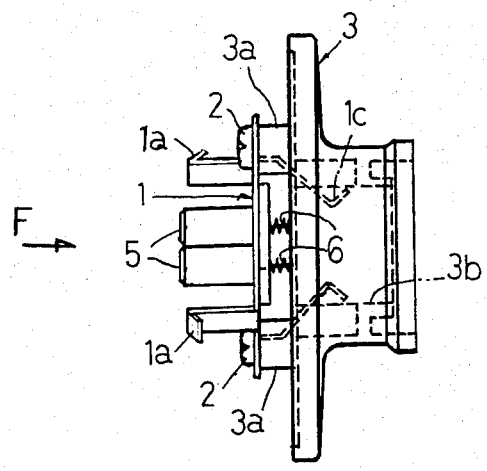
FIG. 3 is a side view of an operating member shown in FIG. 1.
Figure 5:
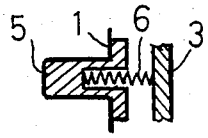
FIG. 5 is a sectional view taken in the direction of the arrows along the line IV—IV of FIG. 4.

A knob 3 has a flange 3*c* with a central opening 3*b* and a central collar 3*d*. The operating plate 1 is secured to a mount 3*a* (FIG. 3) formed on the opposite side of the flange 3*c* of the knob 3 by means of a plurality of screws 2 each extending through the opening 1*d*. Thus, the knob 3 and the operating plate 1 are assembled into an operating unit 4 as shown in FIGS. 3 and 4. In this assembled condition of the operating unit 4, the pair of engaging legs 1*a* extend outwardly of the knob 3, the pair of positioning legs 1*b* extend into the collar 3*d* of the knob 3 and a pair of guide pins 5 extend through the openings 1*c*, respectively, and there is interposed a spring 6 between the flange 3*c* of the knob 3 and each guide pin 5 as in a manner shown in FIG. 5.

Figure 6:
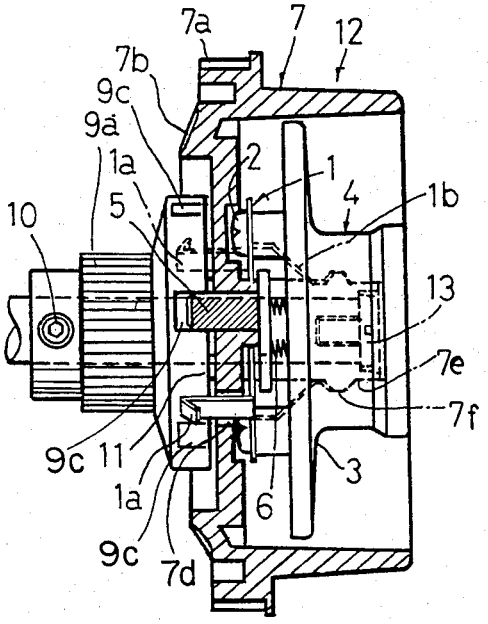
FIG. 6 is a sectional view showing the stop-motion mechanism wherein a pulley unit is connected to an upper shaft.

A pulley 7 is a substantially cylindrical member with a bottom 7*g* and has a belt wheel 7*a* formed integrally therewith to be rotatingly driven by an electric motor by way of a belt (not shown). The pulley is provided with a knurled face 7*b* in the form of a ring on one side thereof, as shown in FIG. 6, for thread winding operation. The pulley 7 has a central hollow axis 7*e*. A pair of openings 7*c* and another pair of openings 7*d* are formed in the bottom 7*g* around the central hollow axis 7*e*. The hollow axis 7*e* has a pair of lumps 7*f* formed on the opposite sides thereof as shown. The hollow axis 7*e* of the pulley is adapted to extend through the central opening 1*e* of the operating plate 1 and the central opening 3*b* of the knob 3 and into the collar 3*d* of the knob 3. On the other hand, the hollow axis 7*e* is adapted to receive an end part of an upper shaft 8 of the sewing machine while permitting relative rotation therebetween.

A transmission disc 9 has a pulley 9*a* for transmitting its rotation to a loop taker shaft (not shown) via a belt (not shown). A plurality of grooves 9*c* are circularly arranged on one side of the disc 9 facing the pulley 7, which grooves are adapted to receive the free ends of the guide pins 5. The disc 9 is secured to the upper shaft 8 by screws 10, with an E-shaped ring 11 being interposed within a notch 8*a* of the shaft 8 and positioned in contact with the side wall of the disc 9.

Figure 7:
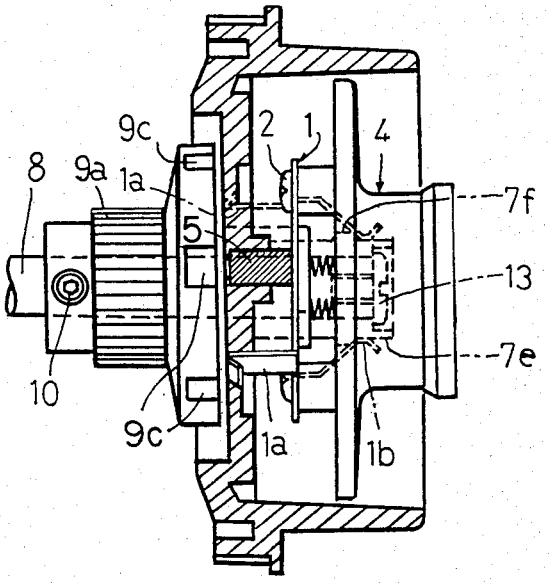
FIG. 7 is a sectional view showing the stop-motion mechanism wherein the pulley unit is disconnected from the upper shaft.

A pulley unit 12 consists of the operating unit 4 and the pulley 7 and is assembled in a manner as will now be described. More particularly, at first, the operating unit 4 is assembled in such manner that, after the guide pins 5 are set to extend through the corresponding holes 1*c* of the operating plate 1, the operating plate 1 is attached to the knob 3 by screws 2 while the springs 6 are interposed between the heads of the guide pins 5 and the knob 3. Then, the operating unit 4 is combined with the pulley 7. The central hollow axis 7*e* of the pulley is inserted into the central opening 1*e* of the operating plate 1 and into the central opening 3*b* of the knob 3 and into the collar 3*d*, where the legs 1*b* of the operating plate 1 are elastically pressed against the central hollow axis 7*e* on the opposite sides thereof on one side of the lumps 7*f* as shown in FIG. 6 or 7. On the other hand, the guide pins 5 are inserted into the guide openings 7*c* of the pulley 7 respectively, and the legs 1*a* of the operating plate 1 are inserted into the openings 7*d* of the pulley 7 respectively. In this condition, the face A of each leg 1*a* is elastically pressed against the edge B of each opening 7*d* as shown in FIG. 2. Thus, when the legs 1*a* are inserted to the full extent as shown in FIG. 6, the hooked end C of each leg 1*a* is far from the inclined edge D of the opening 7*d*. When the legs 1*a* are pulled back as shown in FIG. 7, the hooked end C of each leg 1*a* comes to engage the inclined edge D of the opening 7*d* and is stopped there. Thus, the operating unit 4 is prevented from being taken out of the pulley 7. Further, due to cooperation between the legs 1*a* and the openings 7*d*, the operating unit 4 is prevented from rotation relative to the pulley 7.

As above described, the pulley unit 12 of the invention consists of relatively small number of components and is therefore easy to assemble. Moreover, the pulley unit 12 can be assembled independently of assembly of the transmission disc 9 and any other parts of the sewing machine. More particularly, after the transmission disc 9 is secured to one end of the upper shaft 8, the remaining end part of the upper shaft 8 is inserted into the hollow shaft 7*e* of the pulley 7 until the front face of the transmission disc 9 comes close to the recessed face of the pulley 7, and then a screw 13 is screwed into the threaded axial bore 8*b* of the upper shaft 8 at the enlarged opening 7*h* of the central hollow axis 7*e* of the pulley 7. Thus, the pulley 7 is connected to the upper shaft 8 and to the transmission disc 9, but is rotatable relative to the upper shaft and the disc. Finally, a cap 14 is fitted to the enlarged opening 3*e* of the collar 3*d* of the knob 3. Thereafter, if the operating unit 4 is operated to rotate while the unit 4 is slightly pushed toward the pulley 7 from the condition of FIG. 7 wherein the ends of the legs 1*b* are located on the right side of the lumps 7*f* of the axis 7*e* as shown, a pair of guide pins 5 are forced to engage any one pair of grooves 9*c* by the function of spring 6. The operating unit 4 is then further moved toward the pulley 7 until the unit 4 is stopped, then the condition of FIG. 6 is established wherein the ends of the positioning legs 1*b* come over the lumps 7*f* to the opposite side thereof. Thus, the assembling operation of the stop-motion mechanism is completed.

The above described embodiment of the invention will operate as follows. In the normal position of the operating unit 4 shown in FIG. 6, wherein the ends of pins 5 are inserted into any one pair of grooves 9*c*, the disc 9 and accordingly the upper shaft 8 are rotated when the pulley unit 12 receives drive power from the power source such as an electric motor. In this case the sewing machine is normally driven for stitching operation.

For performing the thread winding operation wherein the upper shaft 8 is to be prevented from rotation and only the pulley unit 12 is to be rotating, the operating unit 4 is pulled in the rightward direction from the condition of FIG. 6 until the unit 4 is stopped due to the cooperation between the hooked ends C of the legs 1*a* and the inclined edges D of the openings 7*d*. Then, the ends of the legs 1*b* come over the lumps 7*f* to the right side thereof as shown in FIG. 7. In this position, the pins 5 are disengaged from the grooves 9*c* and therefore the rotating movement of the pulley unit 12 will not be transmitted to the disc 9 and accordingly to the shaft 8. Thread winding operation may therefore be performed by proper utilization of the ring-shaped knurled face 7*b* of the pulley 7 in the well known manner.

The pulley unit 12 can be easily returned from the position of FIG. 7 to the normal position of FIG. 6 by rotating the unit 12 while slightly pushing the operating unit 4 toward the pulley, as in a manner described before.

According to the stop-motion mechanism embodying the invention, essential parts of the mechanism are constructed as a unit which is easy to remove from the shaft 8 by detaching the cap 14 and screw 13.

As many different embodiments of the invention may be made without departing from the spirit and scope thereof, it is to be understood that the invention is not limited to the specific embodiments thereof except as defined in the appended claims.

What is claimed is:

1. In a sewing machine having a main drive shaft rotated to vertically reciprocate a needle to penetrate a fabric for forming stitches thereon, a stop-motion mechanism comprising:

(a) a rotation transmission member secured near one end part of said main drive shaft and having a plurality of grooves formed thereon;

(b) a plulley rotated by driving means and having a knurled face applicable for thread winding operation and a central hollow axis, said pulley being secured to said end part of said main drive shaft and being prevented from axial movement but rotatable relative to said main drive shaft;

(c) an operating member rotatable together with said pulley but axially displaceable with respect to said pulley between two positions, one position being close to said pulley and the other being away from said pulley; and (d) means for selectively transmitting rotation of said pulley to said rotation transmission member, said means being engaged with any of said grooves of said rotation transmission member so that rotation of said pulley is transmitted to said rotation transmission member for stitching operation, when said operating member is in the position close to said pulley, whereas said means being disengaged from said grooves so that said pulley alone is rotated for thread winding operation, when said operating member is in the position away from said pulley.

2. The stop-motion mechanism according to claim 1 wherein said selective transmission means comprises a member including engaging pins extending through said pulley to be engageable with said grooves of said rotation transmission member.

3. The stop-motion mechanism according to claim 2 wherein said member is secured to said operating member to form an assembled unit.

4. The stop-motion mechanism according to claim 2 or 3 wherein said engaging pins are biased toward said pulley by spring means interposed between said engaging pins and said operating member.

* * * * *